United States Patent [19]

Büth et al.

[11] 3,995,165

[45] Nov. 30, 1976

[54] METHOD OF AND DEVICE FOR SCREENING THE SOURCE OF RAYS DANGEROUS TO HUMAN HEALTH

[75] Inventors: Hans-Wilhelm Büth, Gummersbach; Horst Stürmer, Bergneustadt; Alexander Bock, Gummersbach, all of Germany

[73] Assignee: L. & C. Steinmuller GmbH, Gummersbach, Germany

[22] Filed: Dec. 9, 1974

[21] Appl. No.: 531,031

[30] Foreign Application Priority Data

Dec. 10, 1973 Germany ..... 2361393

[52] U.S. Cl. ..... 250/517; 250/506

[51] Int. Cl.[2] ..... G21F 5/00

[58] Field of Search ..... 250/515–520, 250/505, 506, 510

[56] References Cited

UNITED STATES PATENTS

| | | | |
|---|---|---|---|
| 2,720,105 | 10/1955 | Billups | 250/517 |
| 2,942,115 | 6/1960 | O'Connell | 250/517 |
| 3,090,740 | 5/1963 | Huston et al. | 250/517 |
| 3,256,440 | 6/1966 | Stark | 250/519 |
| 3,534,811 | 10/1970 | Walz | 250/506 |
| 3,680,498 | 8/1972 | Roos | 250/517 |
| 3,785,925 | 1/1974 | Jones | 250/506 |
| R18,349 | 2/1932 | Lapof | 250/517 |

*Primary Examiner*—Harold A. Dixon
*Attorney, Agent, or Firm*—Walter Becker

[57] ABSTRACT

A method of and device for quickly and safely shielding a localized source of rays, according to which easily movable frame means are placed around the localized source of rays and shielding means non-penetrable by the rays of the localized source of rays are by remote control inserted into the frame means.

2 Claims, 5 Drawing Figures

METHOD OF AND DEVICE FOR SCREENING THE SOURCE OF RAYS DANGEROUS TO HUMAN HEALTH

The present invention relates to a method of quickly and safely shielding localized sources of rays as it has been described in assignee's co-pending application Ser. No. 528,802 filed Dec. 2, 1974. In case, for instance of damage or if an inspection is desired in a nuclear power plant, as a rule rays of various types occur. It is for these rays that the respective shielding materials have to be selected. In order to permit an inspection of the source of rays and a repair of the damage, it is necessary to protect the servicing personnel against the automatically occurring rays and possible damage inherent thereto.

With nuclear power plants it is known in case of a radioactively infested damaged area to screen the same by means of lead plates or similarly formed elements in conformity with the type of rays and the intensity thereof. As a rule, this is done by having the servicing personnel to transport these heavy plates to the region of the source of rays, where the plates are piled up in conformity with the location of the radioactively infested damaged area.

All of these known methods have the important drawback that the servicing personnel is for a certain relatively large time period directly exposed to the rays and is therefore, depending on the absorption of rays, no longer suitable for the region of the nuclear power plant. High costs in personnel are the result because only the legally permitted doses may be absorbed by the respective person within a certain specifically defined time unit.

Furthermore, screening operations are known according to which wall-like elements in the form of plates and made of screening material are on rollers or the like transported into the region of the source of rays. This known method is very expensive and cannot be employed everywhere because the places of employment for such elements are frequently inaccessible.

It is, therefore, an object of the present invention quickly and safely to screen localized radiating damaged areas, and more specifically in such a way that the person screening the damaged area will after elimination of the damaged area not be exposed to any post-radiation by a non-controlled wear of the screening materials.

Figure 1:
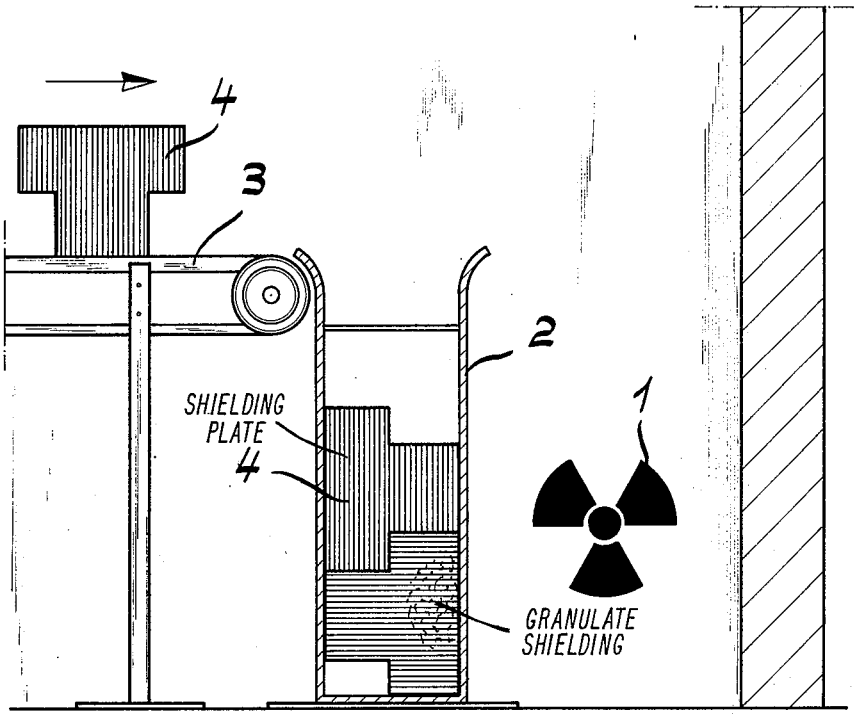

These and other objects and advantages of the invention will appear more clearly from the following specification in connection with the accompanying drawings, in which:

FIG. 1 diagrammatically illustrates a localized source of rays and a framework in which by a transporting device in the form of a conveyor belt the screening elements are conveyed in block form.

Figure 2:
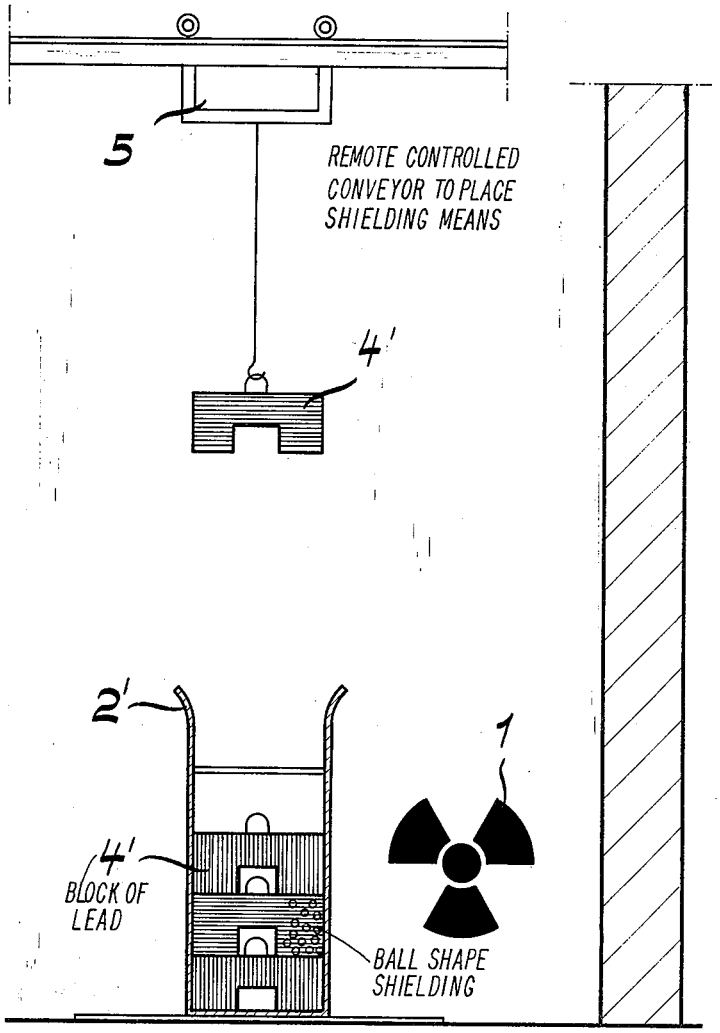

FIG. 2 diagrammatically illustrates a localized source of rays and a frame in which by means of a transporting device in the form of a hoisting device the screening elements are conveyed in the form of blocks or the like.

Figure 3:
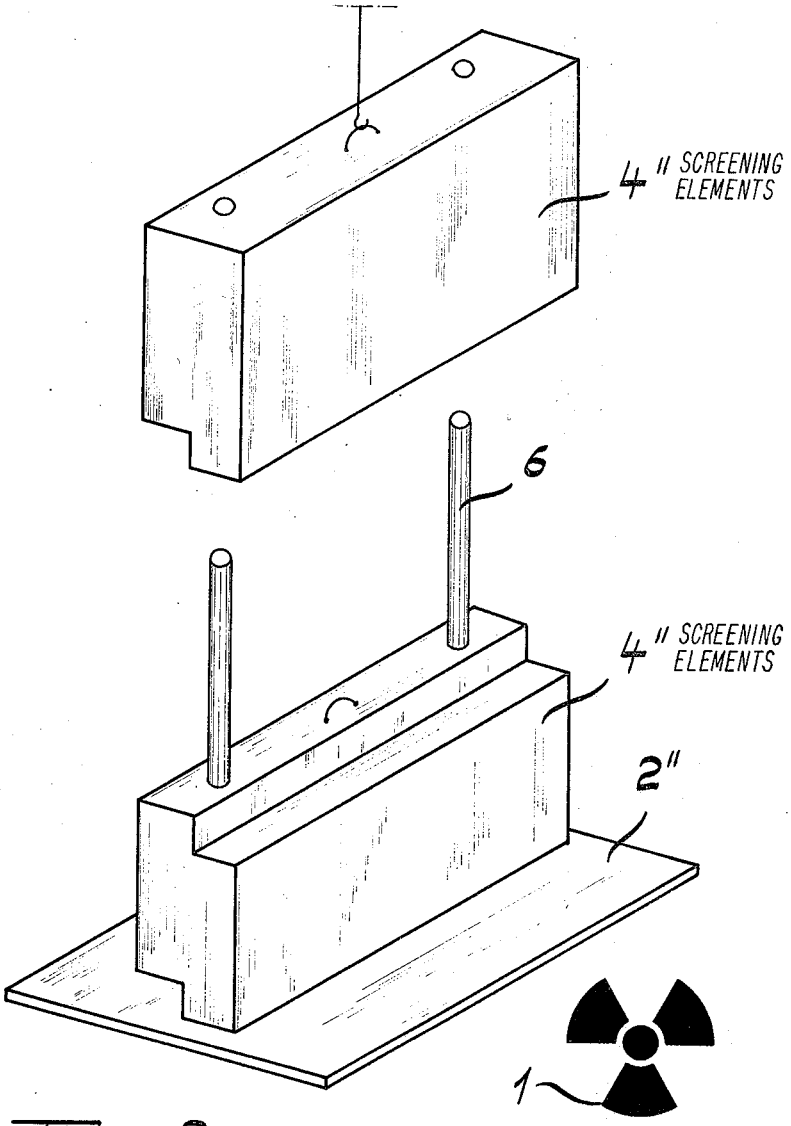

FIG. 3 diagrammatically illustrates a source of rays and a frame in which by means of a hoisting device the screening elements are deposited.

Figure 4:
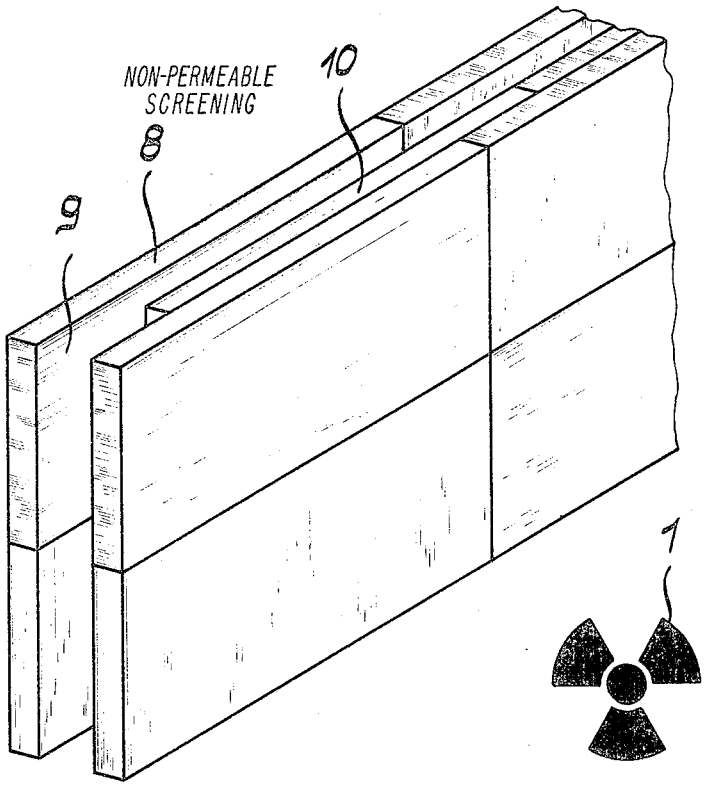

FIG. 4 diagrammatically illustrates a localized source of rays which is secured by means of interconnected self-supporting screening elements.

Figure 5:
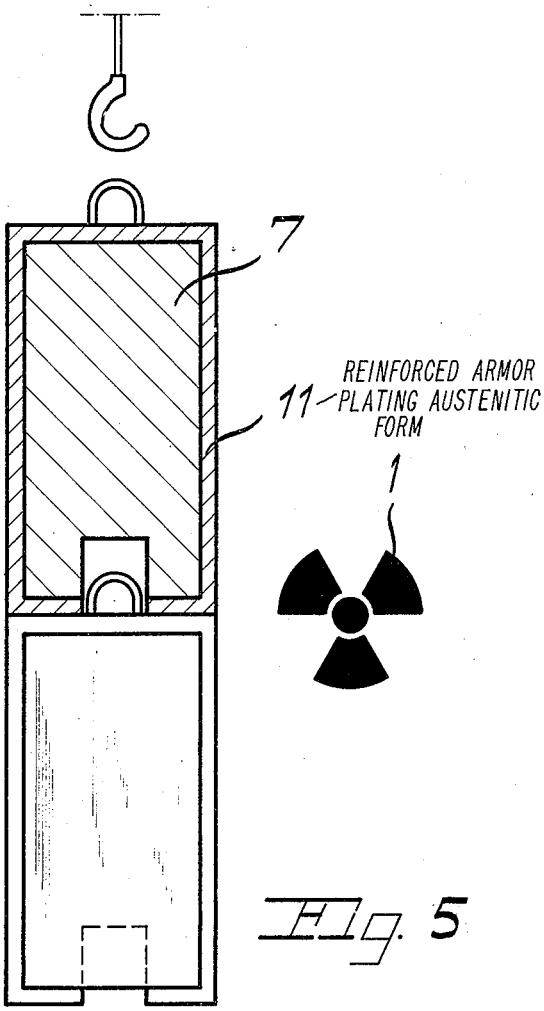

FIG. 5 diagrammatically illustrates a localized source of rays which is secured by means of stiffened and/or reinforced screening elements.

The problem underlying the present invention has been solved according to the present invention by arranging around the region of the source of rays, easily movable and transportable frameworks or the like which from outside the source of rays through the intervention of conveyor elements controlled by a central station are adapted to be filled in conformity with the occurring type of rays by screening elements of lead or the like in plate form, block form, etc. The filling may be effected pneumatically, hydraulically or mechanically.

Furthermore, according to a further development of the invention, easily movable and transportable plates or block-shaped elements are as screening elements of lead or the like in interconnected manner arranged around the region of the source of rays.

For a better placing and a better and safer screening of the damaged areas, it is suggested according to the present invention that the substantially rectangular screening elements have their head ends and/or bottoms provided with guiding elements which interrupt the course of the rays. The arrangement is such that adjacent screening elements supplement each other so that the guiding element of one screening elements engages the guiding element of the adjacent screening element.

In view of the easy deformability of the screening elements, it is, of course, necessary to reinforce the outer edges of the screening element. Therefore, according to a further development of the invention, it is suggested to stiffen and reinforce the outer surfaces of the screening elements and the surfaces of the guiding elements of each screening element by armor plating of another metal in austenitic form.

The advantages realized by the present invention consist primarily in that the servicing and assembly personnel will only very shortly or not at all be exposed to the radioactive rays so that health damage can be avoided. A further advantage of the present invention is seen in the fact that the invention as an integrated system in a nuclear power plant permits a faster and therefore more economical repair and inspection while a better servicing of the nuclear power plant is possible.

Moreover, according to the invention, nearly complete screening is realized with structurally simple means. A further advantage of the present invention is seen in the fact that no worn-off particles and/or dust-like particles occur which automatically after repairing the damaged area could function as new sources of rays and thus could endanger the safety of the servicing personnel later.

Referring now to the drawings in detail, in case of damage, a framework 2, 2', 2'' or the like is built up in the vicinity of the source 1 of rays. By means of a transporting device for instance in the form of a conveyor belt 3 (FIG. 1) screening elements 4 are conveyed into said framework from the outside to the source 1 of the rays. The framework 2 may, for the duration of the source 1 of rays, surround the screening elements 4 in a supporting manner. In case of need, as especially shown in FIG. 2, the framework 2' may be removed without endangering the stability of the wall built-up of screening elements 4'. The feeding of the screening elements 4' is effected expediently by means of a lifting device 5 or the like.

According to the embodiment of FIG. 3, the screening elements 4'' are from a framework 2'' equipped with guiding elements 6, lowered by means of a non-illustrated hoisting device or the like. For purposes of increasing the screening factors, the screening elements 4, 4'' (FIGS. 1 and 3) are so designed that they are braced against each other, however, this design depends, of course, on the desired stability as for instance against forces such as earthquakes or the like.

FIG. 4 shows a plate-shaped screening element 8 in a self-supporting interconnected arrangement while each screening element 8 is equipped with guiding elements in groove 9 and spring-like arrangement 10 at their outer edges.

The screening elements are as a rule for reasons of costs manufactured in simple lead form. However, due to the easy deformability, the inherent low strength of this metal shows up so that for safeguarding the screening against outer forces such as earthquakes and the like and for reasons of stability, the outer surfaces of the screening elements and the guiding elements are to be reinforced and stiffened by means of armor plating with another metal in austenitic form.

It is, of course, to be understood that the present invention is, by no means, limited to the specific showing in the drawings but also comprises any modifications within the scope of the appended claims. Thus, it is also possible to design the screening elements in any technically advisable form in order to assure a safe screening protection.

What we claim is:

1. A method of quickly and safely shielding a localized source of nuclear power plant rays dangerous to human health, which includes in combination the steps of: localizing the source of rays dangerous to human health, arranging easily movable frame means around the region of said localized source of rays, and remote-controlling shielding means so as to fill said frame means therewith while selecting the material of said shielding means in conformity with the respective radiating type of rays of said localized source of rays using as shielding means plates and blocks of lead.

2. A method of quickly and safely shielding a localized source of nuclear power plant rays dangerous to human health, which includes in combination the steps of: localizing the source of rays dangerous to human health, arranging easily movable frame means around the region of said localized source of rays, remote-controlling shielding means so as to fill said frame means therewith while selecting the material of said shielding means in conformity with the respective radiating type of rays of said localized source of rays, and placing said shielding means by remote controlled conveyor means in the form of lead elements arranged as a unit around the region of said source of rays to be shielded.

* * * * *